US007654254B1

(12) United States Patent
Rentz et al.

(10) Patent No.: US 7,654,254 B1
(45) Date of Patent: Feb. 2, 2010

(54) SYSTEMS, APPARATUS, DEVICES, PRODUCTS, AND METHODS RELATING TO BOWSTRING RELEASE

(75) Inventors: Marc T. Rentz, Madison Heights, VA (US); Gregory E. Summers, P.O. Box 498, Madison Heights, VA (US) 24572; Randy V. Summers, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 382 days.

(21) Appl. No.: 11/588,908

(22) Filed: Oct. 27, 2006

Related U.S. Application Data

(60) Provisional application No. 60/755,610, filed on Dec. 30, 2005.

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | | |
|---|---|---|---|---|
| 3,845,752 | A | 11/1974 | Barner | |
| 3,853,111 | A | 12/1974 | Stanislawski et al. | |
| 3,965,884 | A | 6/1976 | Killian | |
| 4,495,705 | A | 1/1985 | Kowalski et al. | |
| 4,509,497 | A | 4/1985 | Garvison | |
| 4,539,968 | A | 9/1985 | Garvison | |
| 4,640,258 | A | 2/1987 | Penney et al. | |
| 4,755,914 | A * | 7/1988 | Bretl et al. | 362/109 |
| 4,791,908 | A * | 12/1988 | Pellis | 124/35.2 |
| 4,854,293 | A | 8/1989 | Roberts | |
| 4,877,009 | A | 10/1989 | Becker | |
| 4,981,128 | A | 1/1991 | Garvison | |
| 4,982,718 | A * | 1/1991 | Hamm et al. | 124/35.2 |
| 5,297,533 | A * | 3/1994 | Cook | 124/88 |
| 5,357,939 | A | 10/1994 | Tentler et al. | |
| 5,439,231 | A | 8/1995 | Roberts et al. | |

(Continued)

OTHER PUBLICATIONS

Zenith Archery Products, "The Comfort Release", 2000, Internet, Revised Apr. 1, 2001, 3 pages.

(Continued)

*Primary Examiner*—John Ricci
(74) *Attorney, Agent, or Firm*—Matthew R. Osenga; Leading-Edge Law Group, PLC; James T. Beran

(57) ABSTRACT

Bowstring release is accomplished with systems, apparatus, devices, products, and methods. A system can, for example, include a release component that can hold and release bowstrings, a light component that can emit light, and a connecting component that can connect the release component and the light component. The light component can, for example, emit predominantly blue, green, or red light to preserve night vision. The release and light can be connected by a handle structure with two telescoping parts whose length can be adjusted to fit one's hand. A bowstring release can pivot or be fixed in position relative to a handle structure. A glove-like structure can have a finger opening and an attached tube-like structure adjacent to the finger opening; in use, the tube-like structure contains the handle structure, which is held by fingers extending through the finger opening. The handle structure can also fit into a concho-type grip.

45 Claims, 14 Drawing Sheets

U.S. PATENT DOCUMENTS

| | | | | |
|---|---|---|---|---|
| 5,520,164 | A | 5/1996 | Huddleston | |
| 5,615,662 | A | 4/1997 | Tentler | |
| 5,649,525 | A * | 7/1997 | Koepf | 124/86 |
| 5,653,214 | A * | 8/1997 | Lynn | 124/35.2 |
| 5,685,286 | A | 11/1997 | Summers | |
| 5,692,490 | A | 12/1997 | Walker | |
| 5,694,915 | A | 12/1997 | Summers | |
| 5,803,068 | A | 9/1998 | Summers | |
| 5,857,452 | A * | 1/1999 | Troncoso | 124/35.2 |
| 5,937,841 | A | 8/1999 | Summers et al. | |
| 5,937,842 | A | 8/1999 | Summers et al. | |
| 5,944,004 | A | 8/1999 | Goff et al. | |
| 6,058,920 | A * | 5/2000 | Tentler | 124/35.2 |
| 6,125,833 | A | 10/2000 | Tentler et al. | |
| 6,205,991 | B1 | 3/2001 | Summers et al. | |
| D440,624 | S | 4/2001 | Case | |
| 6,481,431 | B1 | 11/2002 | Summers | |
| 6,484,710 | B1 | 11/2002 | Summers et al. | |
| 6,571,786 | B2 | 6/2003 | Summers et al. | |
| 6,584,966 | B1 | 7/2003 | Summers et al. | |
| 6,631,709 | B2 | 10/2003 | Carter et al. | |
| 6,647,976 | B2 | 11/2003 | Summers et al. | |
| 6,895,951 | B2 | 5/2005 | Summers et al. | |
| 6,945,241 | B2 | 9/2005 | Pellerite | |
| 6,953,035 | B1 | 10/2005 | Summers et al. | |
| 2003/0154969 | A1 | 8/2003 | Carter | |
| 2003/0159682 | A1 | 8/2003 | Pellerite | |

OTHER PUBLICATIONS

Carter Enterprises,"Release Aids", printed from www.carterenterprises.com on Oct. 10, 2001, 11 pages.

New Releases for 1997 From Stanislawski Archery Prod, 1997, 6 pages.

"Bernie's Can't Punch 'Back Tension' Wrist Strap Release", 1998, 2 pages.

Carter Enterprises, "Solution 3 General Directions for Use", undated, 2 pages.

"Winn Archery's Free Flight", printed from www.winnarchery.com on May 8, 2006, 12 pages.

"Stinger" and "Gloves", printed from www.truball.com on May 13, 2006, 5 pages.

"Superball Tension Releases", printed from www.inventivetechnology.com on May 13, 2006, 2 pages.

* cited by examiner

SYSTEMS, APPARATUS, DEVICES, PRODUCTS, AND METHODS RELATING TO BOWSTRING RELEASE

This application claims the benefit of U.S. Provisional Patent Application No. 60/755,610, filed Dec. 30, 2005, entitled "Systems, Apparatus, Devices, Products and Methods Relating to Bowstring Release" and incorporated herein by reference.

BACKGROUND OF THE INVENTION

The present invention relates generally to bowstring release techniques.

U.S. Pat. No. 4,509,497 describes a bowstring release mechanism that includes a triggered-latch mechanism affixed to a sheet of resilient, non-stretchable material. The sheet is shaped to overlie the palm of an archer's hand and to be strapped around the wrist, and has a thumbhole. Many other bowstring release devices with triggers or hand- or wrist-engaging parts for holding release devices have been proposed, including, for example, in U.S. Pat. Nos. 3,845,752; 4,539,968; 4,854,293; 4,981,128; 5,439,231; 5,937,841; 5,937,842; 6,205,991; 6,481,431; and 6,484,710.

It would be advantageous to have improved techniques relating to bowstring release.

SUMMARY OF THE INVENTION

The invention provides various exemplary embodiments, including systems, apparatus, devices, products and methods. In general, the embodiments are implemented in relation to release of bowstrings.

These and other features and advantages of exemplary embodiments of the invention are described below with reference to the accompanying drawings.

DETAILED DESCRIPTION

Figure 1:
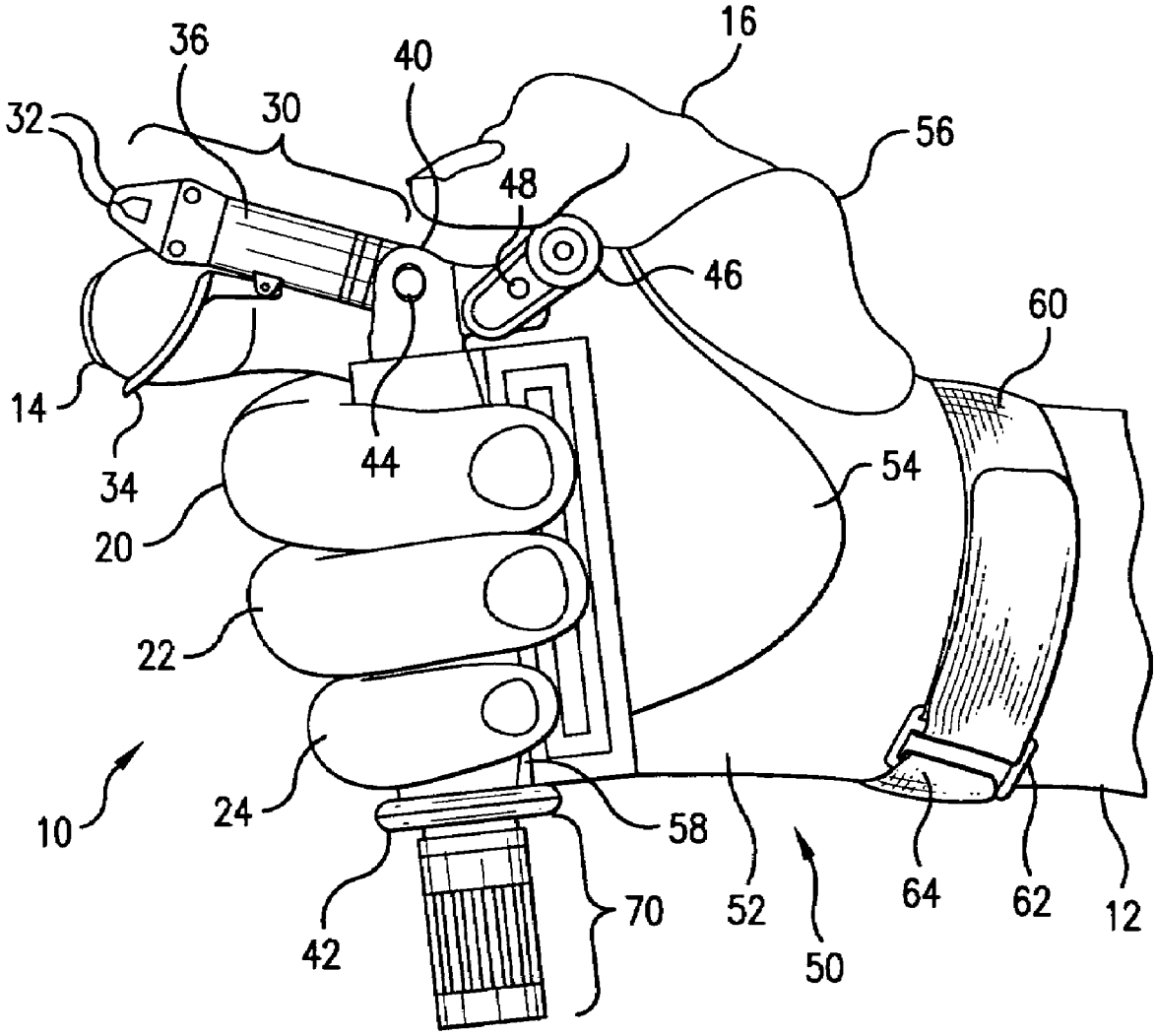
FIG. 1 is a perspective view of a hand, with a glove-like wearable component on the hand, holding a bowstring release that includes a release component and a light component mounted on a handle structure.

In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the claims.

The term "bowstring release" is used herein to mean a device used by an archer in pulling a bowstring to a drawn position and then releasing the bowstring to fire an arrow. Archers have discovered that such devices improve their performance, and various types of bowstring releases have been developed.

The implementations described below address problems that arise with previous bowstring releases. One problem is that archers sometimes walk to or from a hunting site or a vehicle in darkness, carrying their bowstring releases with them; it can be awkward or inconvenient to carry a flashlight or lantern as well as a bowstring release. Other problems relate to bowstring releases that are held by a handle, such as the type around which an archer's fingers extend to grip the handle.

In general, the implementations described below involve combinations of parts or components. As used herein, a "system" is a combination of two or more parts or components that together can function as a whole. One component of a system can, for example, be a "release component", meaning a component that can be operated to hold and release a bowstring. Other parts or components can perform other functions, such as a "light component" to provide light; a "hand-engaging component" that can engage a person's hand, such as by being worn on or held by the hand; a "wearable component" that can be worn on a hand, wrist or other body part; a "selecting component" that can be operated to make a selection; a "pivotable component" that can pivot; a "stopping component" that can stop movement of another part or component, holding it in place; or a "connecting component" that connects other parts or components.

In the implementations described below, apparatus, systems, or parts or components of apparatus or systems are referred to as "attached" to each other or to other apparatus, systems, parts, or components or vice versa, and operations are performed that "attach" apparatus, systems, or parts or components of apparatus or systems to each other or to other things or vice versa; the terms "attached", "attach", and related terms refer to any type of connecting that could be performed in the context. One type of attaching is "mounting", which occurs when a first part or component is attached to a second part or component that functions as a support for the first. In contrast, the more generic term "connecting" includes not only "attaching" and "mounting", but also making other types of connections such as between or among parts formed as a single piece of material by molding or other fabrication, in which case connected parts are sometimes referred to as "integrally formed". Connecting does not, however, include a mere transitory contact or engagement, such as the momentary engagement of a bowstring with a release or with a loop attached to a release while a bow is drawn.

A combination of one or more parts connected in any way is sometimes referred to herein as a "structure". Similarly to a component, a structure may be described by its function, such as a "handle structure" that can function as a handle, a "handle holding structure" in which a handle structure can be held, a "support structure" that can function as a support, a "wearable structure" that can be worn, a "light structure" that an produce light, or a "fastening structure" that can fasten or be fastened. Some structures are also described by structural features. For example, a "tube-like structure" is a structure that, like a tube, has an internal opening or "inner space" extending through it, such as an opening that can contain a handle structure; and a "glove-like structure" is a structure that can be worn on a hand similarly to a glove.

FIG. 1 shows hand 10 on wrist 12 with index finger 14, thumb 16, and other fingers 20, 22, and 24. Hand 10 is holding several components that function together as a system.

Release assembly 30 is a release component that could be implemented in a wide variety of different ways. In the illustrated example, jaws 32 can directly or indirectly hold a bowstring that is being drawn by hand 10; then, when index finger 14 (or optionally any of the other fingers) pulls trigger 34, jaws 32 are pulled apart and release the bowstring. This is one example of a "trigger mechanism," used herein to mean a mechanism that is actuated by moving a movable part connected with a catch, detent, or the like; in this case, trigger 34 is the movable part, and finger 14 illustratively can actuate the trigger mechanism, causing release of the bowstring. In one high-quality implementation, jaws 32, trigger 34, and housing 36 are all stainless steel parts, but release assembly could be made of any suitable materials and could be any currently available or hereafter developed type of bowstring release that can be used in the context, including those used in the Copperhead, Titan, Steelhead, Silverback, and other releases available from T.R.U. Ball® Release, Madison Heights, Va.

Release assembly 30 is pivotably mounted on handle structure 40. Release assembly 30 is therefore an example of a pivotable component "mounted pivotably relative to" a handle structure, meaning that it is mounted so that it can pivot relative to handle structure 40. As explained in greater detail below, release assembly 30 can "pivot about an axis relative to" a handle structure, meaning that its pivoting relative to handle structure 40 occurs about a pivot axis. Handle structure 40 extends from a disk-like base 42 at one end up to an opposite end at which release assembly 30 pivots or swivels on axis pin 44, which is centered on the pivot axis.

Handle structure 40 also supports thumb pin 46, and the position of thumb pin 46 can be fixed in a desired position using a screw (not shown) that extends from the rear into screw hole 48. As described in greater detail below, the length of handle structure 40 between thumb pin 46 and base 42 is also adjustable to fit the size of hand 10. In addition, thumb pin 46 makes it easier for an archer to pull the draw weight during a bowstring draw cycle.

Figure 2:
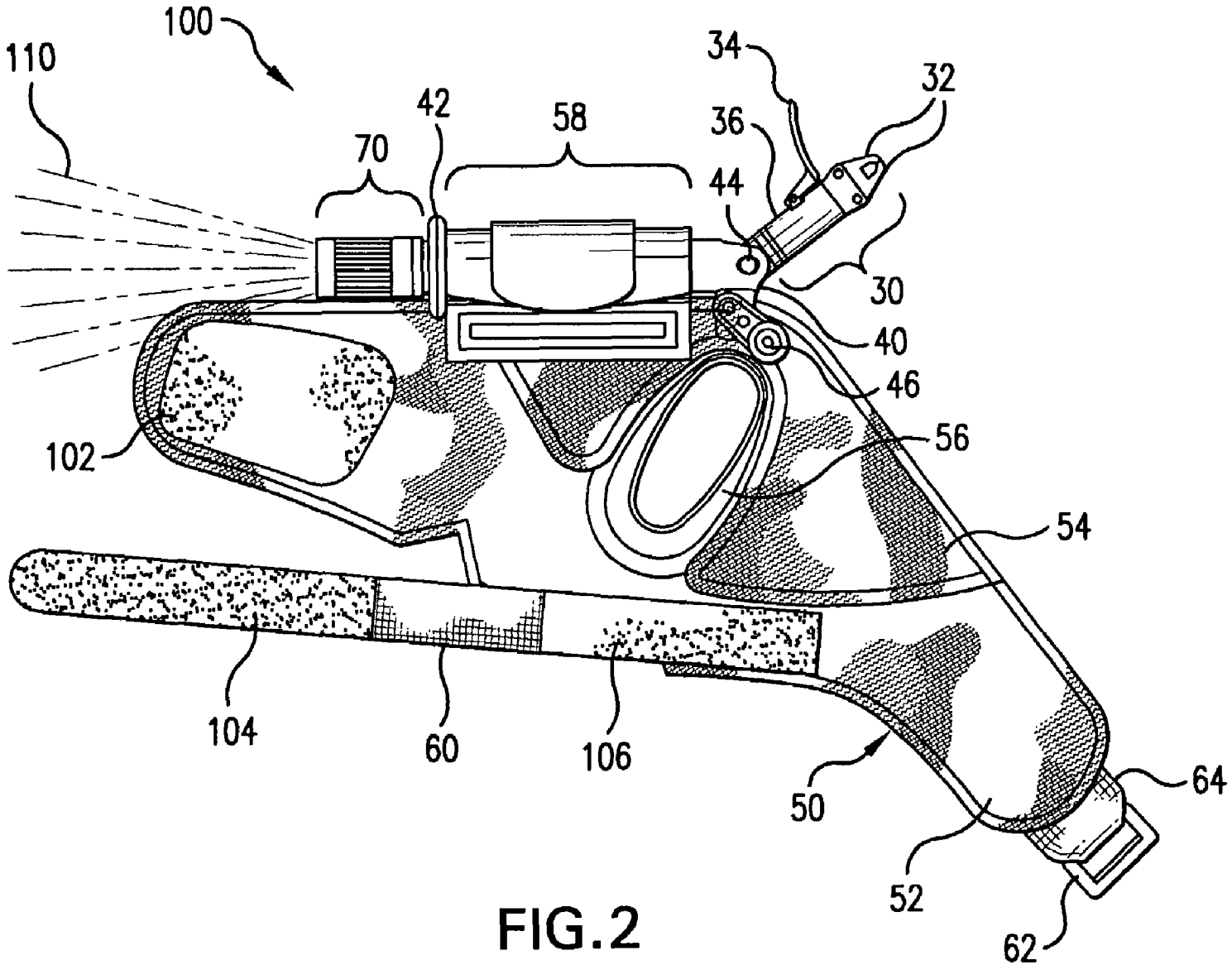
FIG. 2 is a side view of a system that includes components similar to those shown in FIG. 1 with the wearable component in an open position.

In addition to a release component that includes release assembly 30 as described above, hand 10 is holding a hand-engaging component, and specifically a wearable component illustrated by glove-like structure 50. Structure 50 is illustratively a layered, sewn structure that includes outward layers 52 and 54 (which can have a camouflage appearance as shown in FIG. 2) as well as thumb sleeve 56 and handle sleeve 58, a tube-like portion of structure 50 adjacent the opening through which fingers 14, 20, 22, and 24 extend. Handle structure 40 can, for example, include a two-part detachable tube whose length can be adjusted by turning disk-like base 42 relative to the remainder of handle structure 40.

When the two parts of the tube are detached, they can be inserted into the approximately equal-sized openings at the ends of sleeve 58 and reattached to each other within the "approximately cylindrical" inner space inside it. The term "approximately cylindrical" means that the inner space's outer boundary has approximately the shape of a cylinder. The inner space need not, however, be circular, and could accommodate a handle with any appropriate shape, such as an elliptical shape that is ergonomic. Further, the tube-like structure may be flexible, in which case the inner space may change in shape.

Sleeve 58 therefore functions as a handle holding structure with an inner space that extends between first and second openings. This is just one example of how a handle structure can be "inserted" into an inner space of a handle holding structure with its first and second ends extending out of the first and second openings of the inner space; in general, a handle structure could be "inserted" into an inner space by any operation that begins with the handle structure not in the inner space and ends with the handle structure in the inner space, including operations by which webbing is attached around the handle to enclose the inner space and also operations in which parts of a handle structure are attached within or outside the inner space by metal hardware or fasteners of any suitable kind.

When release assembly 30 is mounted on handle structure 40 and handle structure has been inserted into the inner space, the result is an archery device in which a bowstring release extends "through the inner space and out of" both openings, meaning that a bowstring release is not confined at either end of the tube-like structure's inner space, but rather continues the full length of the inner space and beyond it at both ends through the openings. As will be understood from the description below, a device with this feature permits attachment of a stopping component, a light component, or other useful components at the end of the bowstring release opposite its release component.

After insertion, the length of the tube can be adjusted to fit one's hand, such as the width across one's palm and fingers. Handle structure 40 therefore has an adjustable length between its ends "to fit different widths of hands," meaning that the length can be adjusted to fit more than one different hand width. In addition, thumb sleeve 56 is positioned relative to handle sleeve 58 so that one's thumb extending through thumb sleeve 56 can engage thumb pin 46 as shown when the length of the tube is appropriately adjusted. The central opening within sleeve 36 is an example of a "thumb opening," meaning an opening through which a thumb can extend.

Glove-like structure 50 can be secured on hand 10 by tightening of strap 60, which extends through ring 62 and can adhere to itself due to hook-and-loop material as described in greater detail below. Ring 62 is also attached to structure 50 by strap 64, such that tightening of strap 60 results in a secure fit around wrist 12. Additional fastening structures are described in greater detail below.

FIG. 1 illustrates an example of a wearable structure that has a "finger opening" defined therein when worn, meaning an opening that one's fingers extend through. In the illustrated example, the fingers extend through the finger opening in a direction (sometimes referred to herein as a "finger direction) that is approximately perpendicular to the direction in which the handle-containing opening or inner space extends within sleeve 58, a flexible tube-like structure. Fingers 20, 22, and 24 are shown extending through the finger opening and around the tube-like structure to hold handle structure 40 in the inner space of the tube-like structure; as a result, the fingers hold the bowstring release within the tube-like structure.

The components in FIG. 1 also include light structure 70, a light component that can emit light similarly to a flashlight. Various features of light structure 70 are described in greater detail below. Handle structure 40 functions as a connecting component, connecting light structure 70 to release assembly 30.

FIG. 2 shows system 100, with components similar to those shown on hand 10 in FIG. 1. Similar components of system 100 are labeled with the same reference numerals as in FIG. 1.

In contrast to FIG. 1, system 100 is shown with glove-like structure 50 in an open position in which it is nearly flat. In addition, strap 60 is extended to its full length rather than being threaded through ring 62. Layer part 102 includes hook-and-loop material such as Velcro®, and therefore can also be used in fastening structure 50 around a hand, in cooperation with another layer part on the reverse side of structure 50, as described below. Also, strap 60 has two attached pieces 104 and 106 of hook-and-loop material such as Velcro®, so that when strap 60 extends through ring 62 and is tightened and folded over, pieces 104 and 106 adhere to each other, holding strap 60 tight.

FIG. 2 also illustrates ray pattern 110 emitted by light structure 70. Light structure 70 can, for example, include a light emitting diode (LED), bulb, or other light source that can emit light predominantly in a narrow frequency band of a single visible color such as blue, red, or green. Although light that is predominantly within a narrow band ordinarily does not significantly interfere with night vision as white light or other broadband visible light would, light structure 70 could nevertheless be used instead with a broadband light source such as a white flashlight bulb. A light source that emits light that does not significantly interfere with normal human night vision is referred to herein as emitting light "in a way that preserves night vision."

Ray pattern 110 is sufficiently narrow in relation to intensity of light from light structure 70 yet has sufficient spread that the emitted light has "a ray pattern sufficient to illuminate nearby objects", meaning that ordinary objects within a few steps of the user are illuminated and reflect sufficient light emitted by structure 70 that they can be seen in context by a person with normal vision when they are within ray pattern 110. For example, ray patterns sufficient to illuminate objects within distances up to 5 feet, 10 feet, or 15 feet could be available using different light sources in light structure 70. The user can therefore avoid nearby obstacles when walking, can find and retrieve nearby items such as from the ground, can look at a map or other printed item, and so forth. A commonplace example of a ray pattern sufficient to illuminate nearby objects is a typical flashlight beam.

It should be noted that a narrow beam laser or similar narrow beam light source can illuminate a nearby object, but can usually only illuminate a small part of the object because it does not spread sufficiently to illuminate the object and its context. A narrow beam light source of that type is fundamentally different than a light source with "a ray pattern sufficient to illuminate nearby objects" and instead might be useful in targeting an animal or other nearby object as described in U.S. Pat. No. 6,945,241. In contrast, a flashlight beam or other ray pattern sufficient to illuminate nearby objects would not typically be useful for targeting because its area of high intensity spreads too quickly; for example, at an arm's-length distance, its area of half-maximum intensity could spread from less than an inch to approximately the size of the palm of one's hand or larger.

Figure 3:
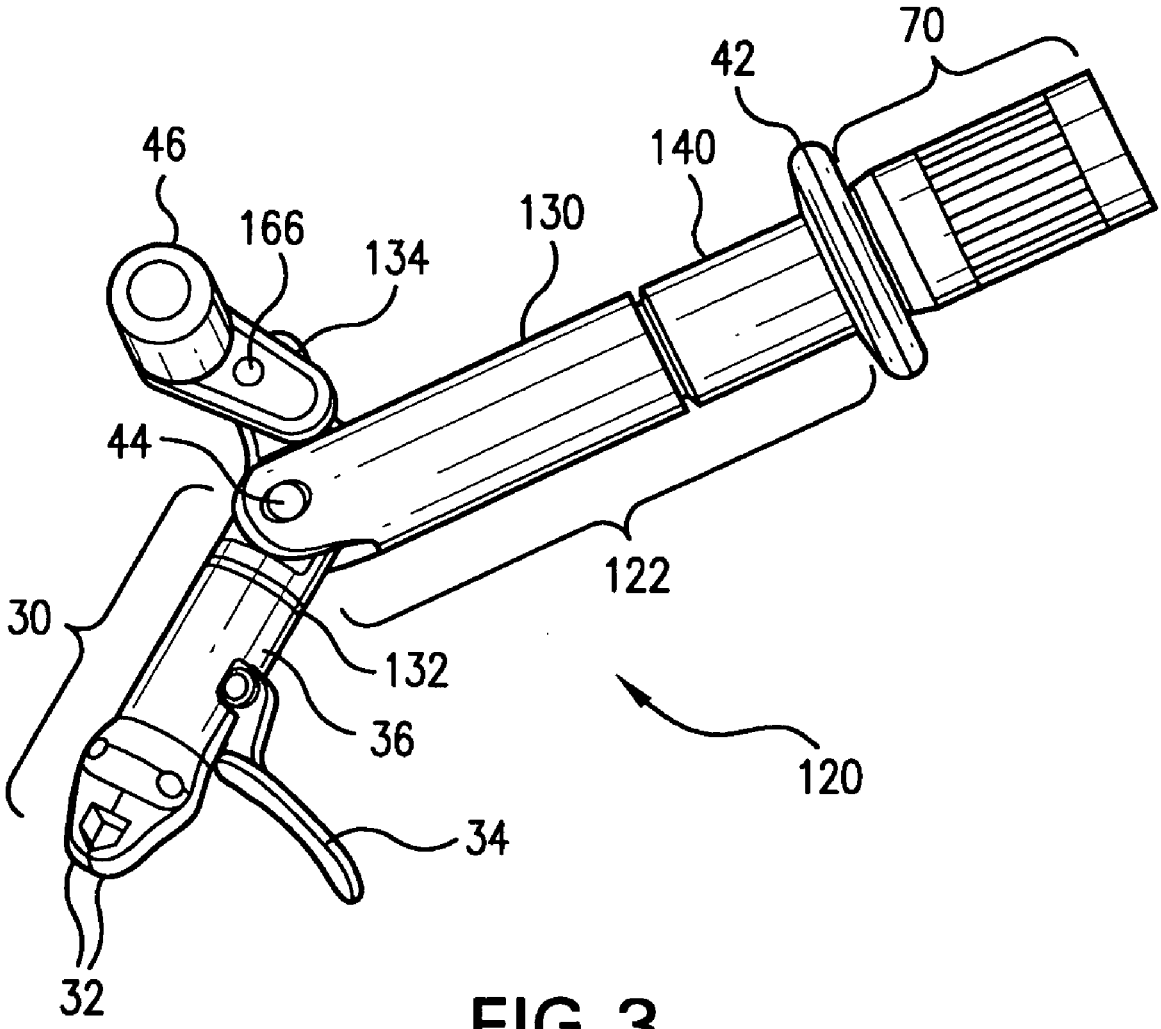
FIG. 3 is a perspective view of apparatus that could be used in FIGS. 1 and 2, including a release component and a light component mounted on a handle structure.

FIG. 3 shows apparatus 120, which could be used as in system 100 in FIG. 2 or in FIG. 1. Similar components of apparatus 120 are labeled with the same reference numerals as in FIGS. 1 and 2.

In addition to a release component that includes assembly 30 and a light component that includes structure 70, apparatus 120 includes handle structure 122 that can extend between and connect the release component and the light component, functioning as a connecting component. Handle structure 122 includes outer part 130, described in greater detail below. Outer part 130 supports swivel part 132, mounted on axis pin 44 and in turn supporting release assembly 30. Outer part 130 also supports tear drop connector 134 on which thumb pin 46 is mounted; connector 134 and thumb pin 46 could be any suitable currently available or hereafter developed parts.

Handle structure 122 also includes inner part 140, which fits within and engages with outer part 130 as described in greater detail below. Base 42 and light structure 70 are mounted on inner part 140. As a result, when outer part 130 and inner part 140 are connected, release assembly 30 and light structure 70 are in turn connected through them.

Apparatus 120 in FIG. 3 can be part of a product that includes one or more hand-engaging components. The hand-engaging components could include a set of glove-like structures as described above or other wearable structures and could also include one or more "concho-type grips," where the term "concho-type grip" refers to a relatively rigid structure that is gripped within the palm of a person's hand rather than being worn or otherwise attached to the outer surface of the hand.

Apparatus 120 could be included in such a product in the assembled form shown in FIG. 3 or, alternatively, the product could include one or more of each of the components of apparatus 120, with, for example, a single handle structure 122 but a set of release components that are mountable on the handle structure and a set of light components that are mountable on the opposite end of the handle structure. This would allow the purchaser of the product to select a desired combination of components, mount the selected release component and light component on the handle structure, and then insert the handle structure into the inner space of the handle holding structure of a selected hand-engaging component.

Although the particular implementation in FIG. 3, described in greater detail below, employs a telescoping adjustable and detachable two-part handle structure that can be held directly, inserted into a tube of a concho-type grip, or inserted into a tube-like sleeve of a wearable component, various other types of handle structures could be used to implement the techniques described herein. For example, a handle structure with a different number of parts or with a different technique for telescoping, adjustment, and detachment could be employed; instead of using threaded surfaces to adjust length, telescoping parts could be locked at a desired length with an eccentric locking collar, a key and set screw, a rod and set screw, or other technique. In addition, rather than being connected by a handle structure or other hand-engaging component, a release component and a light component as described herein could be connected to each other by various other types of connecting components in various other configurations. The particular configuration in FIGS. 1-3, however, enables a user to hold the hand in one position when using the release component and then to hold the hand in another position, such as a raised position, when it is desired to illuminate nearby objects using the light component, an example in which the light component and release component would not be operated concurrently.

Figure 4:
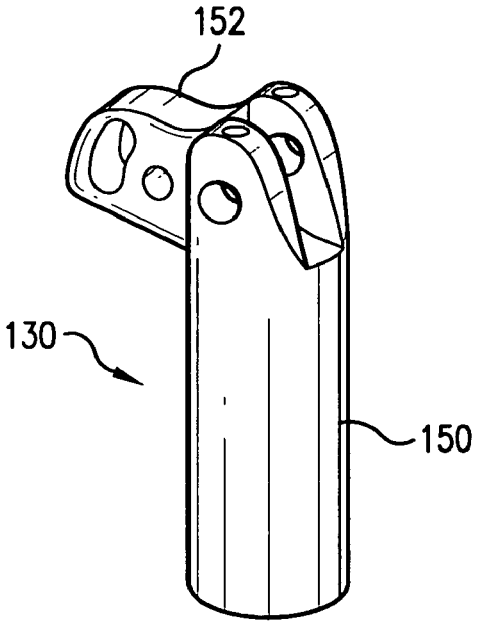
FIG. 4 is a perspective view of an outer part of a handle structure as in the apparatus of FIG. 3.

FIG. 4 shows outer part 130 separately. Outer part 130 can be fabricated in any appropriate way, such as by machining, by casting and then machining, by investment casting, or by another process applicable to aluminum or by molding or otherwise fabricating any other suitable material, including various metals and plastics. After fabrication, outer part 130 can be coated with a suitable finish, such as an anodized black dye. The main parts of outer part 130 are body portion 150 and arm portion 152. In an exemplary implementation, the outside diameter of body portion 150 is approximately 0.63" and its height can be approximately 2.25". Arm portion 152 extends approximately 0.60" outside the diameter of body portion 150, and has a width of 0.24".

Figure 5:
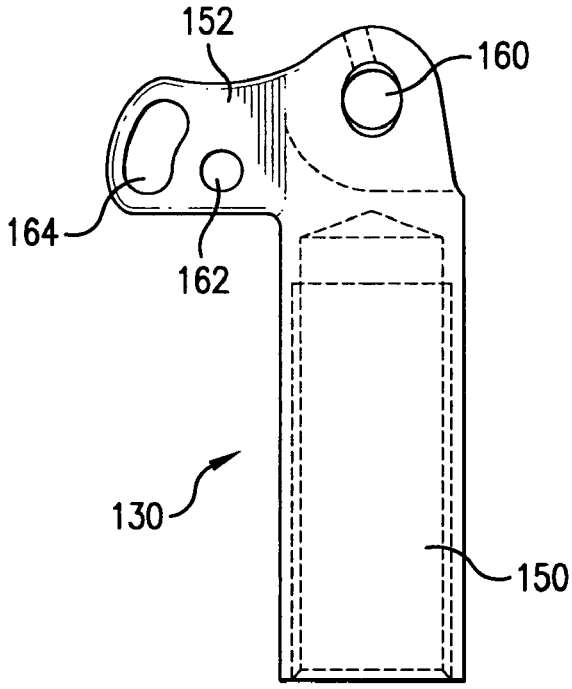
FIG. 5 is a side view of the outer part of FIG. 4.

As shown in FIG. 5, body portion 150 includes pin opening 160 through which pin 44 can extend. Pin opening 160 can have a radius of approximately 0.189". As shown by the dashed lines in FIG. 5, body portion 150 also has a hole or bore extending to a depth of approximately 1.55" from the end opposite arm portion 152. Approximately 1.4" of this hole can be threaded.

Arm portion 152 has pivot opening 162 and range limiting opening 164 defined in it. For example, the center of pivot opening 162 can be approximately 0.52" from the center of pin opening 160, and its radius can be approximately 0.13". In use, connector 134 can have a knob or pin that extends into pivot opening 162 and a screw extends through range limiting opening 164 and into screw hole 166 (FIG. 3), so that connector 134 can pivot about the pin in opening 162 across the range permitted by opening 164. The screw can be tightened to hold connector 134 in position when thumb pin 46 is appropriately positioned.

Figure 6:
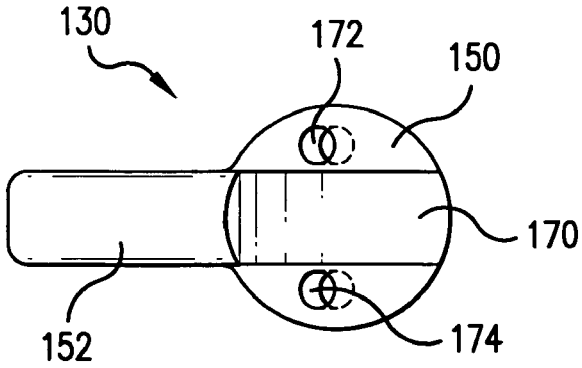
FIG. 6 is a top view of the outer part of FIGS. 4 and 5.

FIG. 6 shows additional features of body portion 150 that allow for appropriate mounting of swivel part 132, providing the mounting of a pivotable component on a handle structure. Central groove 170 has a width of approximately 0.24" to accommodate a tongue portion of swivel part 132. Screw holes 172 and 174 are each positioned approximately 0.2" from the center line of groove 170 and permit screws to be tightened against flat portions of pin 44 to prevent pin 44 from turning relative to outer part 130.

Figure 7:
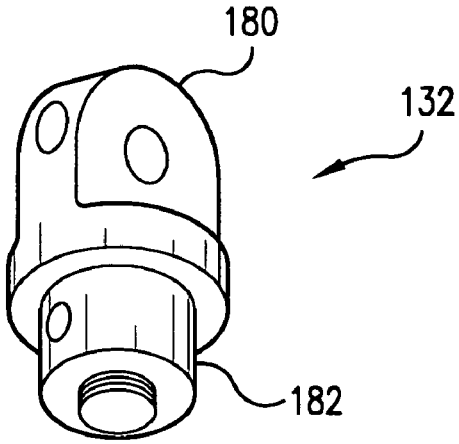
FIG. 7 is a perspective view of a swivel part as in the apparatus of FIG. 3.

FIG. 7 shows swivel part 132, which can be fabricated using any of the materials and processes mentioned above for outer part 130 or other suitable materials and processes. As shown, swivel part 132 includes tongue portion 180 and release mount portion 182. The overall height of swivel part 132 can be approximately 0.894", of which release mount portion 182 can include 0.27".

Figure 8:
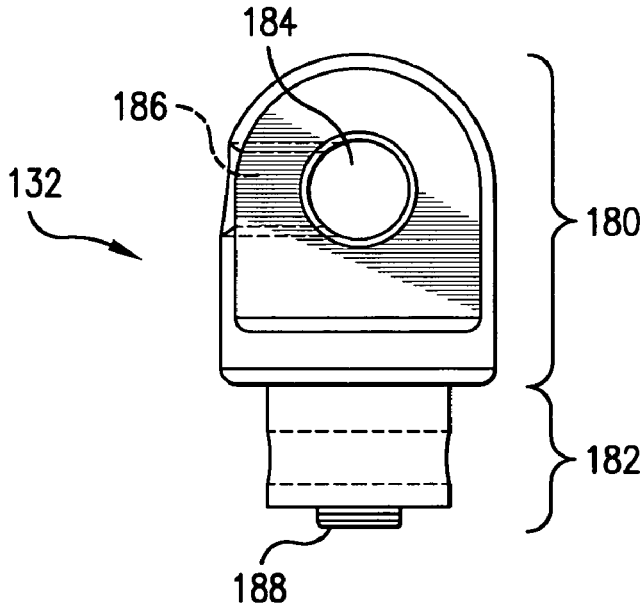
FIG. 8 is one side view of the swivel part of FIG. 7.

FIG. 8 shows a side view of swivel part 132 in which pin opening 184 has been defined, with a radius of approximately 0.189". As shown by the dashed line to the left of opening 184, set screw hole 186 is in tongue portion 180, allowing a set screw (FIG. 13) to be tightened to hold swivel part 132 in a fixed position relative to pin 44. Pin 44 and the set screw therefore function as a selecting component that can be operated by a user to select one of a set of pivot modes; in the illustrated example, the modes include a first mode in which the pivotable component can pivot about the axis of pin 44 through a range of positions relative to the handle structure and also a second mode in which the pivotable component is fixed in a position within the range. To select the first mode, the user loosens the set screw so that it does not engage pin 44; to select the second mode, the user tightens the set screw to hold the pivotable component in a fixed position.

FIG. 8 also shows in profile that the lower end of release mount portion 182 has knob 188, a conventional feature that assists in more stably mounting the remainder of release assembly 30 on swivel part 132, such as by fitting into a drilled hole in the facing surface of swivel part 132. In general, however, release assembly 30 could be mounted using any suitable currently available or hereafter developed technique.

Figure 9:
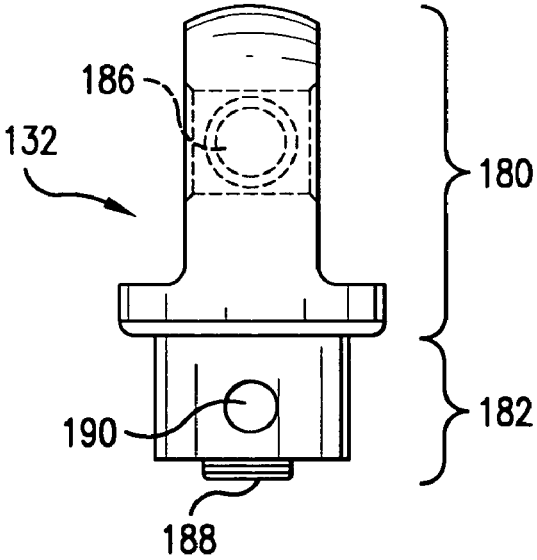
FIG. 9 is another side view of the swivel part of FIGS. 7 and 8.

FIG. 9 shows swivel part 132 from a different side, turned 90° from the view in FIG. 8. In FIG. 9, it can be seen that tongue portion 180 has a width of approximately 0.235" so that it fits into groove 170 in outer part 130. In addition, release mount portion 182 includes mount opening 190, used together with knob 188 to obtain a strong, stable mounting to the remainder of release assembly 30.

Figure 10:
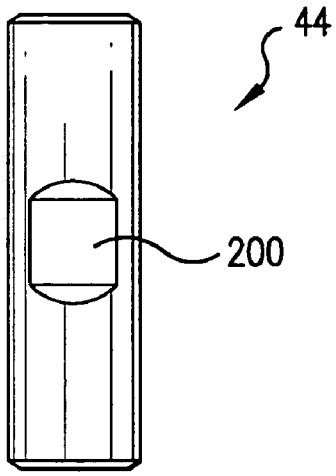
FIG. 10 is a side view of an axis pin as in the apparatus of FIG. 3.

FIG. 10 shows pin 44, which can be stainless steel or any other suitable material, with a diameter of approximately 0.1875" so that it fits and can turn within openings 160 and 184. Pin 44 can have a length of approximately 0.63", the same as the diameter of body portion 150. Pin 44 has flat area 200 extending along approximately 0.13" of its length and centered between its ends to receive a set screw extending through opening 186 in swivel part 132.

Figure 11:
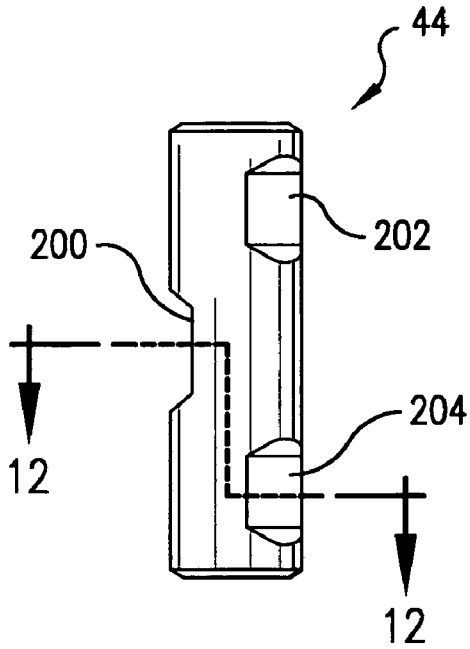
FIG. 11 is another side view of the axis pin of FIG. 10.

FIG. 11 also shows flat areas 202 and 204, each extending approximately 0.10" and centered approximately 0.113" from its respective end of pin 44. Flat areas 202 and 204 are therefore positioned to receive screws extending through screw holes 172 and 174 in outer part 130 to hold pin 44 in a fixed position relative to outer part 130. As will be understood, one or both of these screws must be tightened to allow operation of the selection component described above.

Figure 12:
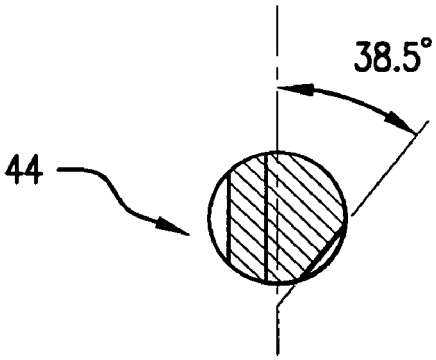
FIG. 12 is a cross-sectional view of the axis pin of FIGS. 10 and 11, taken along the line 12-12 in FIG. 11.

FIG. 12 is a cross-section of pin 44 taken along line 12-12 in FIG. 11, showing that the angular difference between flat area 200 and flat areas 202 and 204 is approximately 38.5°. Accordingly, swivel part 132 can be held in a stable position in which it has the same angle relative to screw holes 172 and 174, which are illustratively at an angle of approximately 15° from the axis of outer part 130 in FIG. 5.

Figure 13:
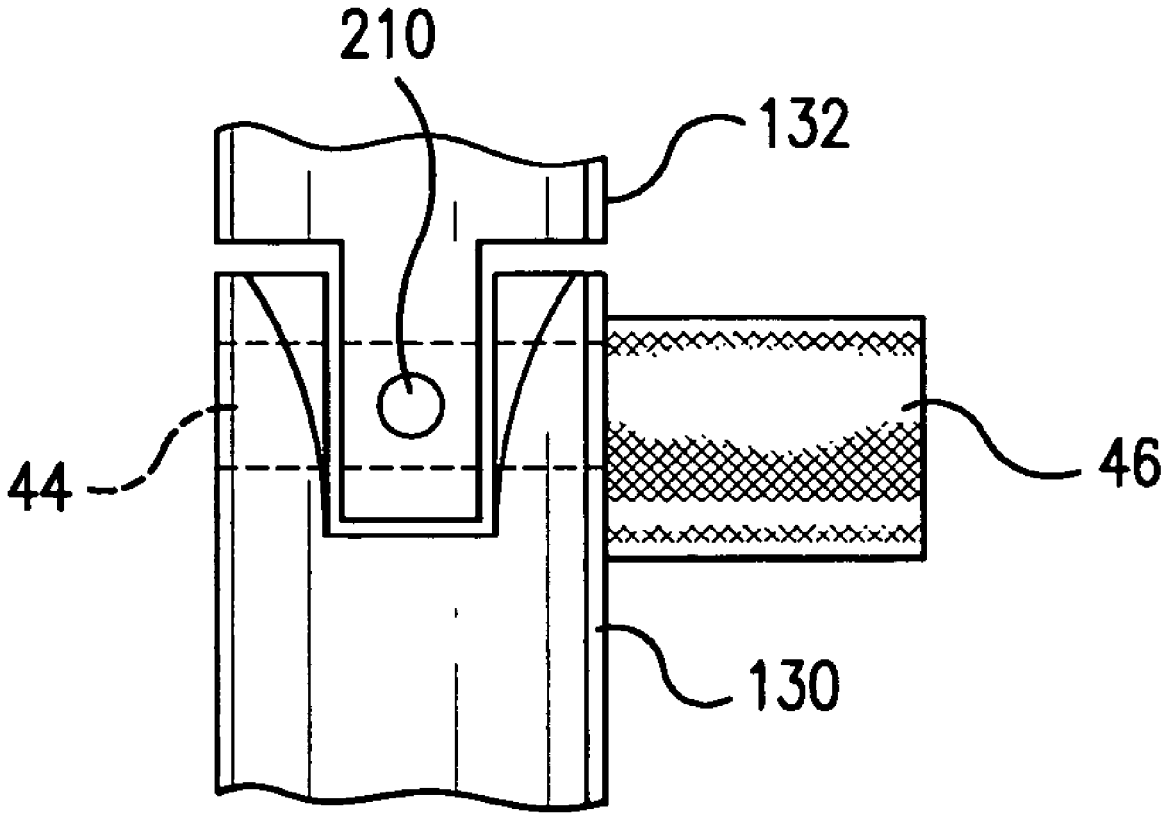
FIG. 13 is a top view of a detail of the apparatus of FIG. 3, showing a set screw that engages an axis pin as in FIGS. 10-12 to fix the position of a swivel part as in FIGS. 7-9 relative to an outer part as in FIGS. 4-6.

FIG. 13 shows a detail of the mounting of swivel part 132 on outer part 130. As can be seen, set screw 210 can be tightened against pin 44 to hold swivel part 132 in a fixed position in which the release stays aligned with a target. For example, a product could be marketed with swivel part 132 held in the stable position by set screw 210, allowing a user to loosen set screw 210 so that swivel part 132 is free to float in response to pressure due to pulling or drawing a bowstring. From the point of view shown in FIG. 13, thumb pin 46 is also visible, but it plays no part in the mounting of swivel part 132.

Figure 14:
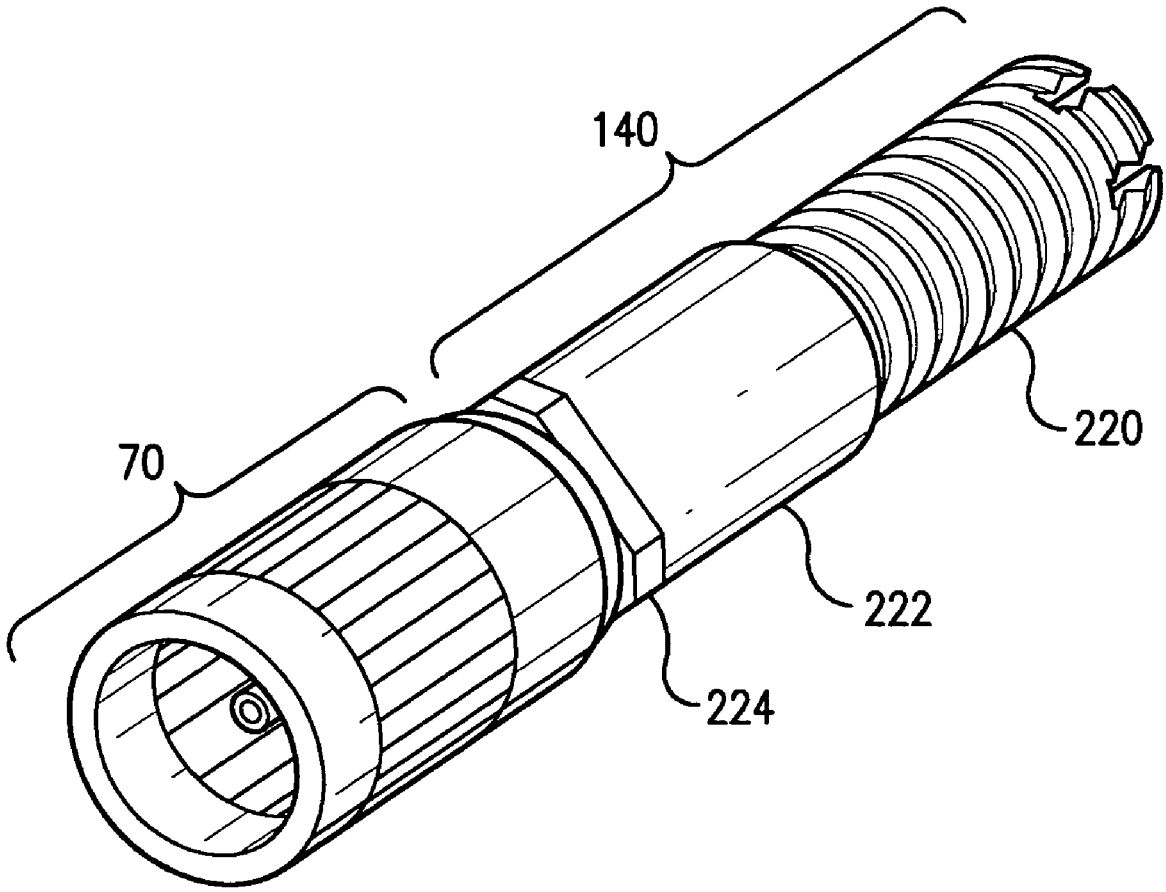
FIG. 14 is a perspective view of a light component with part of a handle structure as in the apparatus of FIG. 3.

FIG. 14 shows light structure 70 mounted on inner part 140 of handle structure 122, without disk-like base 42. Three different segments of inner part 140 are shown, including threaded segment 220, round segment 222, and square segment 224.

Figure 15:
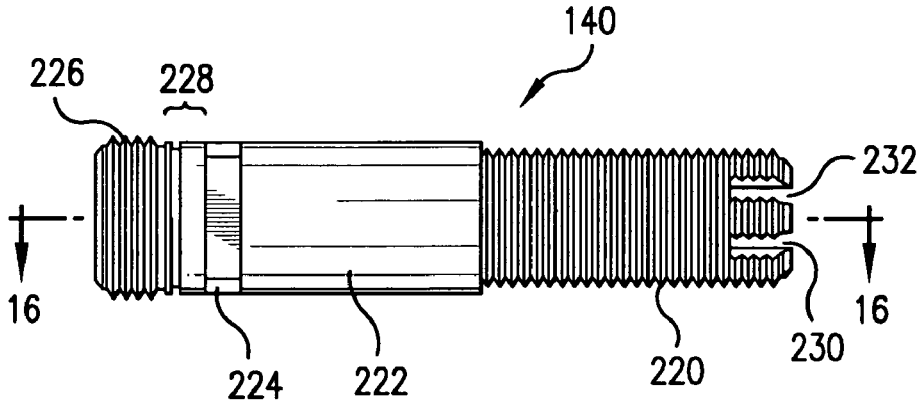
FIG. 15 is a side view of an inner part of a handle structure as in the apparatus of FIG. 3.

FIG. 15 also shows inner part 140, including the segments shown in FIG. 14 and also light mount segment 226 and base mount segment 228. If light component 70 is dimensioned in metric units, dimensions of inner part 140 are also most easily expressed in metric units. The overall length of inner part 140 can, for example, be approximately 73.96 mm, and it can, for example, be fabricated from stock that is 16 mm square. More generally, inner part 140 can be fabricated using any of the materials and processes mentioned above for outer part 130 or other suitable materials and processes.

In fabricating inner part 140, slots 230 and 232 can be formed at the end of threaded segment 220, prior to threading. In addition, a bore can be made from the end of threaded segment 220. After threading, the end part can then be flared out approximately 0.25 mm to provide a friction fit with the inner threading of outer part 130.

Figure 16:
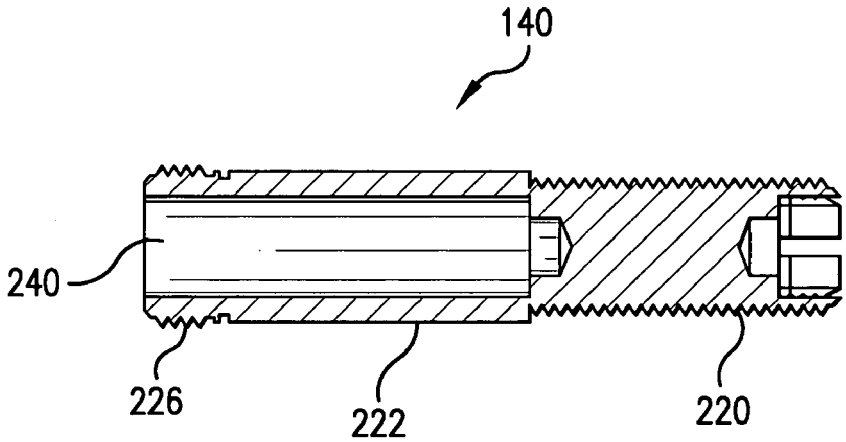
FIG. 16 is a cross-sectional view of the inner part of FIG. 15, taken along the line 16-16 in FIG. 15.

FIG. 16 shows a cross section of FIG. 15, illustrating additional features of inner part 140. In addition to the bore at the end of threaded segment 220, FIG. 16 shows battery compartment 240 at the opposite end, a bore extending to a depth of approximately 40.64 mm and with an inner diameter of approximately 10.668 mm, to accommodate a standard AAA battery in the resulting battery compartment 240. Compartment 240 is an example of a "chamber to hold a battery," meaning a chamber suitable to hold an electrical battery within it.

A light source powered by a battery is one example of a light source "that emits light in response to electrical power," meaning a light source that, upon receiving electrical power in some form, responds by emitting light; in general, any appropriate light source responding to any appropriate form of electrical power could be used. In the direct current implementation of FIGS. 14-16, light component 70 necessarily includes an electrical circuit with connections to both poles of the battery, so that installation of light component requires insertion into battery compartment 240 of connecting circuitry (not shown), which can be implemented with conventional components. Then, when light component 70 is tightened onto light mount segment 226, a circuit is closed, so that light can be emitted. Loosening of light component 70 can open the circuit, ending emission of light. These features are an example of a "switch mechanism," meaning a mechanism that can be operated to open and close an electrical circuit. The illustrated switch mechanism includes a support structure on which light component 70 is rotatably mounted, with the support structure including inner part 140; the switch mechanism opens and closes the circuit in response to rotation of light component 70 relative to the support structure, either to loosen or tighten the connection between light component 70 and light mount segment 226.

Light component 70 can be any suitable light-emitting component using currently available or hereafter developed techniques. To minimize noise due to clinking or banging, it could have a rubber-like surface or boot over its end.

Figure 17:
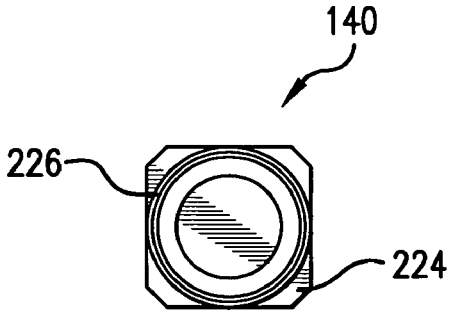
FIG. 17 is an end view of the inner part of FIGS. 15 and 16, taken from the left.

Light mount segment 226 can be fabricated in whatever way is appropriate for light component 70. For example, in a current implementation, light mount segment 226 includes a 9 mm segment that is threaded and is spaced apart from square segment 224 by base mount segment 228. When viewed from the end as shown in FIG. 17, the corners of square segment 224 extend outside the diameter of light mount segment 226, and therefore can be used to prevent turning of base 42 relative to inner part 140.

Figure 18:
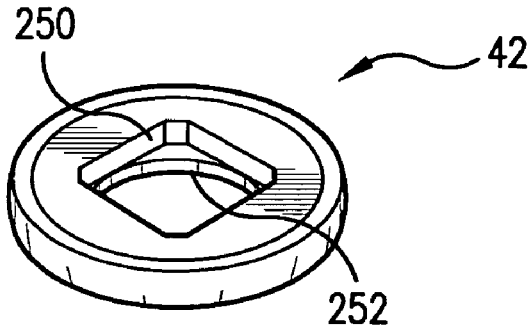
FIG. 18 is a perspective view of a disk-like base as in the apparatus of FIG. 3 that can be mounted on an inner part as in FIGS. 15-17.

FIG. 18 shows base 42 with square opening 250 and, below it, circular opening 252. The two openings are concentric, and can be produced from a molded hard rubber or plastic, such as nitrile or Buna N with a Shore A durometer value of 35 to 70; more generally, base 42 can be fabricated using any of the materials and processes mentioned above for outer part 130 or other suitable materials and processes.

Figure 19:
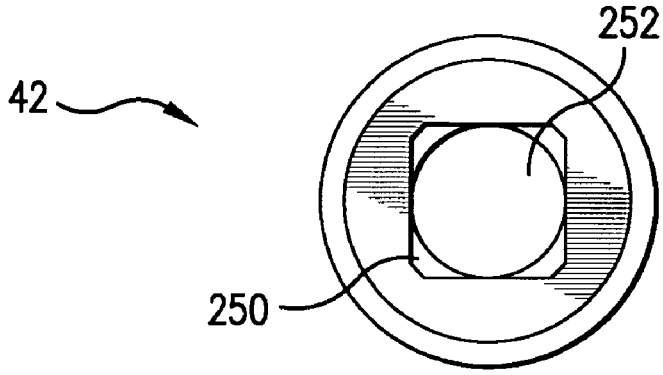
FIG. 19 is a top view of the disk-like base of FIG. 18.
Figure 20:
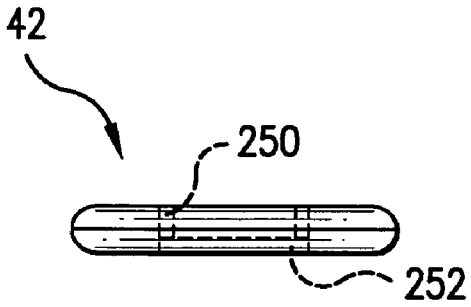
FIG. 20 is a side view of the disk-like base of FIGS. 18 and 19.

As shown in the top view of FIG. 19, the diameter of round opening 252 is almost equal to the length of a side of square opening 250. For example, round opening 252 can have a diameter of approximately 0.625", while square opening 250 can have a side length of approximately 0.630", sufficient to fit around square segment 224 of inner part 140, while round opening 252 fits around base mount segment 228. FIG. 20 shows a side view in which square opening 250 and round opening 252 are shown by dashed lines.

Figure 21:
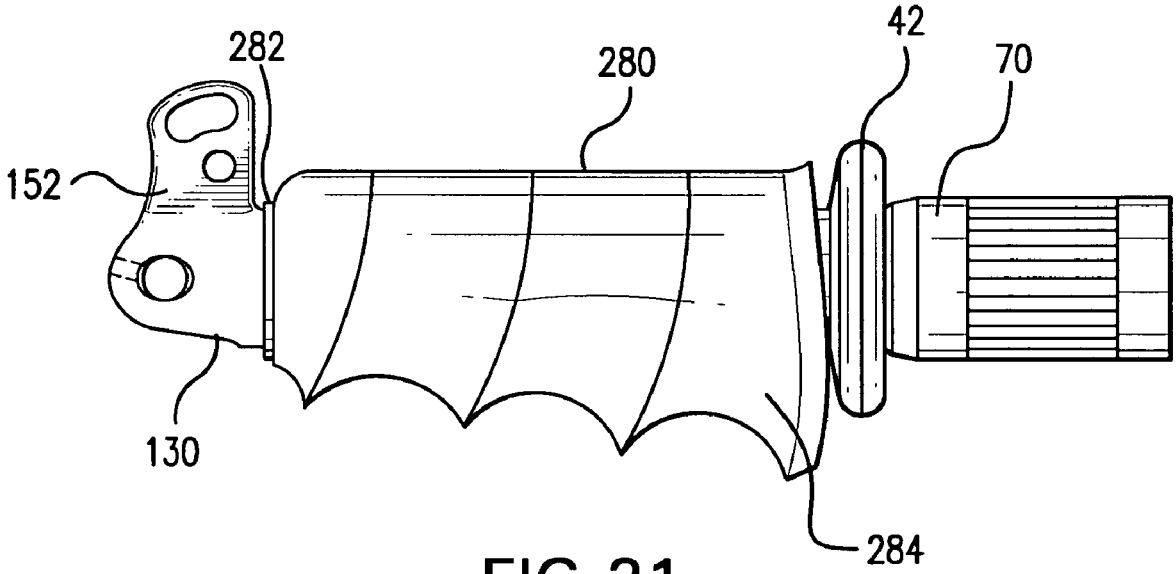
FIG. 21 is a perspective side view of a concho-type grip that can be used with apparatus as in FIG. 3.

FIG. 21 illustrates how concho-type grip 280 with finger grooves can be mounted on handle structure 122 between arm portion 152 of outer part 130 and base 42. Concho-type grip 280 can include tube 282 and, on it, shaped portion 284 fabricated from any appropriate material such as rubber, plastic, or wood, with or without finger grooves, with adjustable finger grooves, or, as in the illustrated implementation, can be formed from a putty-like material shaped to fit a user's hand and then hardened; tube 282 can, for example, be aluminum or other suitable material, and functions as a handle holding structure. The inner diameter of tube 282 is slightly larger than the outer diameter of outer part 130 and inner part 140, so that outer part 130 and inner part 140 can be inserted into respective ends of concho-type grip 280 and turned together until one end of tube 282 meets arm portion 152 and the other end meets base 42. At that point, concho-type grip 280 is held stably in position.

In an alternative implementation, a concho-type grip (not shown) is similar to a rubber or plastic bicycle handle. The grip can, for example, be molded from a hard rubber or plastic, such as nitrile or Buna N with a Shore A durometer value of 35. The grip can include a tube-like base that functions as a handle holding structure with a friction fitting inner cylindrical opening. For example, if the outer diameter of parts 130 and 140 is approximately 0.63 inches, the inner diameter of the cylindrical inner opening can be approximately 0.005 inches less, providing friction fit.

In this alternative implementation, lengthwise-extending rows of regular, slightly flexible knobs can be integrally formed with the base and can extend outward from the base's outer surface, to provide a firm but comfortable grip. If the diameter to the base's outer surface is approximately 0.85 inches, for example, the outermost diameter to the tops of the knobs can be approximately 0.94 inches. The grip can have eight equal-width rows of the knobs, for example, with each knob having a rectangular outer surface at the outermost diameter. Each knob's side surfaces can be slanted so that facing side surfaces of adjacent knobs are at approximately 100 degrees to each other, both lengthwise and around the circumference of the outer surface. Adjacent rows of knobs around the circumference can be spaced, such as by approximately 0.1 inches, while adjacent knobs in a row can have little if any separation. Each knob's effective width in the lengthwise direction can be approximately 0.16 inches. In general, the grip can have any suitable length for comfortable handling, with one possible length being approximately 3.3 inches.

As can be seen from FIGS. 4, 14-16, and 21, outer part 130 and inner part 140 can be adjusted to accommodate various lengths of concho-type grips for different hand sizes, with each grip being held snugly between arm portion 152 and base 42 after inner part 140 is tightened into outer part 130. The same is true, of course, for different sizes of glove-like structures of the type illustrated in FIGS. 1 and 2, further examples of which are described in greater detail below. In these implementations, base 42 can function as a stopping component, holding a hand-engaging component in place on a handle structure.

As described above, outer part 130 is an end part with an inner threaded surface while inner part 140 is an end part with an outer threaded surface, and the threaded surfaces are capable of "turning against each other," meaning that they fit with each other and a user can turn one or both of the end parts to cause the threaded surfaces to turn or rotate relative to each other. For example, if the two end parts are not connected, they can be rotated relative to each other so that the inner threaded surface turns inside the outer threaded surface, forming a connection between the parts. Similarly, once they are connected, the end part can be rotated relative to each other to adjust the length of a handle structure by turning the inner and outer threaded surfaces against each other. Finally, the end part can be rotated relative to each other to turn the inner and outer threaded surfaces against each other and disconnect the end parts from each other.

The use of end parts that can be connected, adjusted, and disconnected while within the inner space of a tube-like structure, as described above, can be easy, cost-effective, and ergonomic. This technique is useful both with flexible tube-like structures as described above in relation to FIGS. 1 and 2 and also with rigid metal tubes as described above in relation to FIG. 21.

Figure 22:
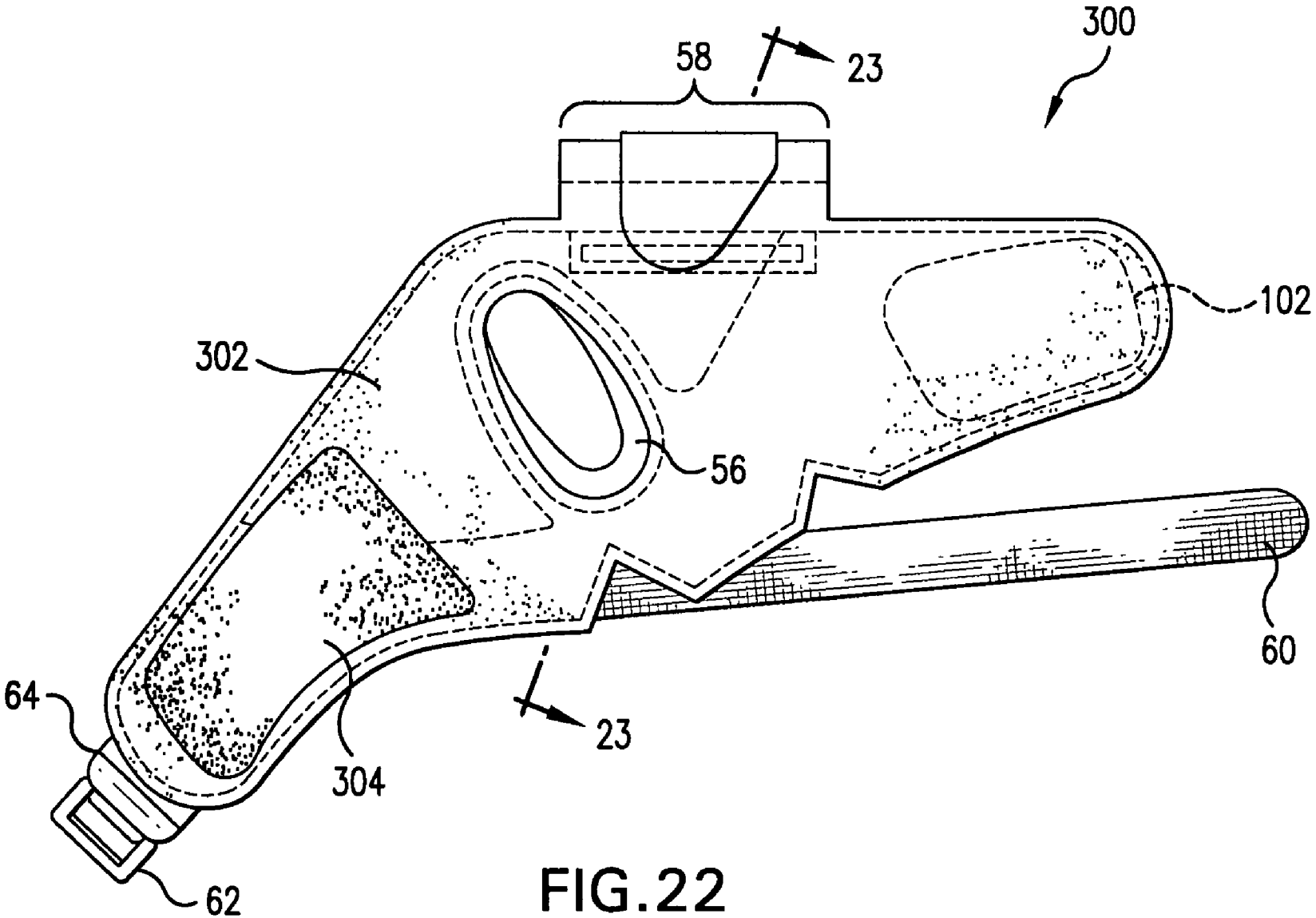
FIG. 22 is a view of the reverse side of a layered glove-like structure similar to those in FIGS. 1 and 2.

FIG. 22 shows glove-like structure 300 similar to those in FIGS. 1 and 2, but from the side opposite that shown in FIG. 2. Similar components of structure 300 are labeled with the same reference numerals as in FIGS. 1 and 2.

Structure 300 is a hand-engaging component, and specifically a wearable component. It is illustratively a layered, sewn structure with inside layer 302 the primary layer that contacts a user's hand when worn. Attached to layer 302 is layer part 304, a layer of hook-and-loop material such as Velcro®, positioned to attach to layer part 102, shown in outline in FIG. 22. Layer 302 also extends partway around handle sleeve 58, where it is reinforced by layer part 306.

Figure 23:
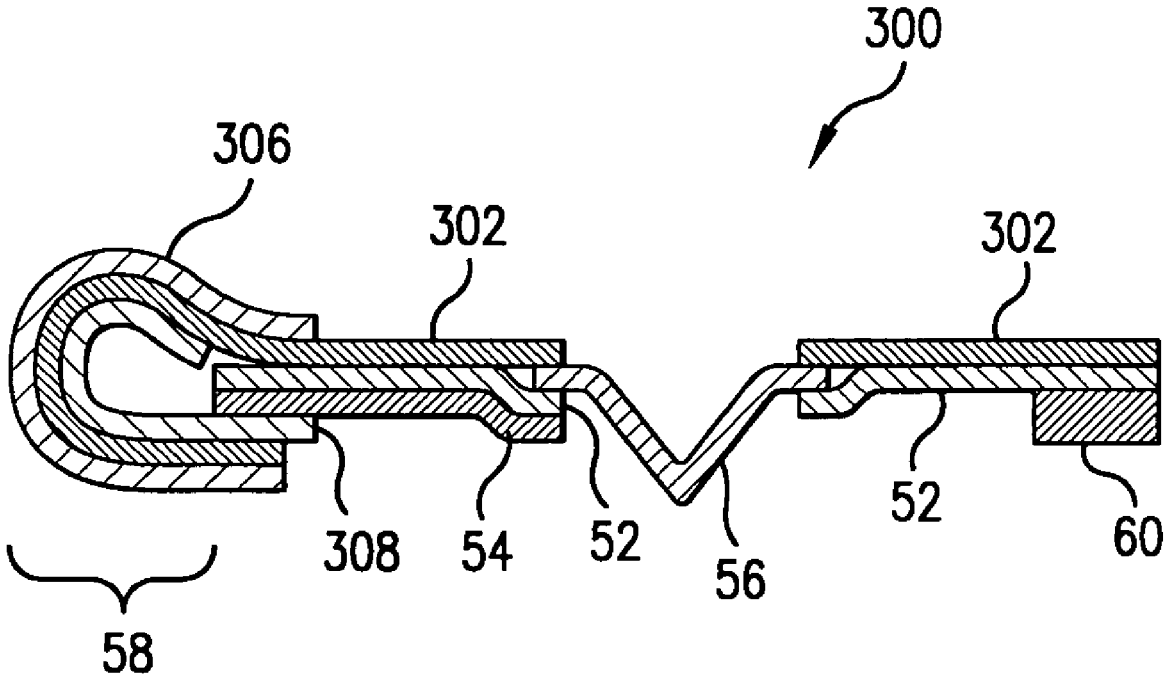
FIG. 23 is a cross-sectional view of the layered glove-like structure of FIG. 22, taken along the line 23-23 in FIG. 22.

The details of structure 300 can be understood more fully from the cross-section in FIG. 23, in which thicknesses of layers are exaggerated to facilitate illustration. Tube-like sleeve 58, shown at the left in FIG. 23, is formed by layer 302 and layer parts 306 and 308, all of which are sewn together, producing a flexible tube-like, handle holding structure with an approximately cylindrical inner space that extends between two approximately equal-size openings. Adjacent to sleeve 58, layer part 308 is also sewn to layer 302, with outward camouflage layers 52 and 54 between them. Outward camouflage layers 52 and 54 extend to where thumb sleeve 56 is sewn between layer 52 and layer 302, with the opening into thumb sleeve 56 positioned relative to sleeve 58 so that one's thumb can engage a thumb pin as described above. At the right in FIG. 23, strap 60 is sewn to the underside of structure 300.

Camouflage material for layers 52 and 54 can have any appropriate pattern, such as TREBARK®, REALTREE®, or MOSSY OAK®, and could be any suitable fabric or other similar material; alternatively, layers 52 and 54 could have a non-camouflage appearance or any other suitable appearance. Layer 302, layer parts 306 and 308, and thumb sleeve 58 can be a soft leather or simulated leather material appropriate for being in contact with skin for an extended period of time.

Figure 24:
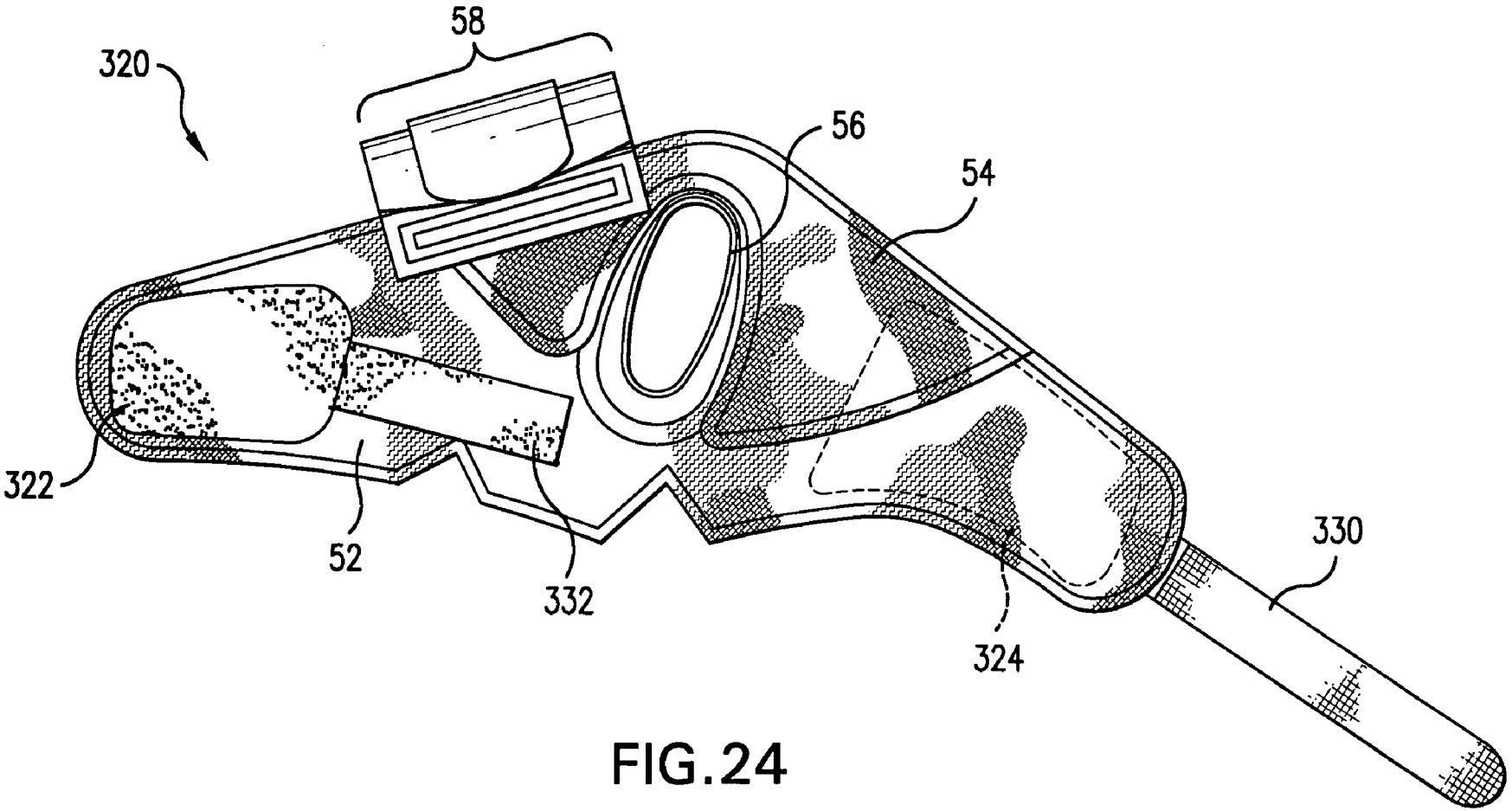
FIG. 24 is a top view of another layered glove-like structure similar to those in FIGS. 1, 2, 22, and 23.

FIG. 24 shows glove-like structure 320 similar to those in FIGS. 1, 2, 22, and 23, viewed from the same side as in FIG. 2. Similar components of structure 320 are labeled with the same reference numerals as in FIGS. 1, 2, 22, and 23, and components that are not described in detail can be implemented as described above in relation to FIGS. 1, 2, 22, and 23. Specifically, despite its differences, structure 320 can be used in a system similar to that in FIGS. 1 and 2.

Like structure 300, structure 320 is a hand-engaging component, and specifically a wearable component. It is illustratively a layered, sewn structure that includes outward camouflage layers 52 and 54 as well as thumb sleeve 56 and handle sleeve 58, a flexible tube-like structure adjacent the opening through which fingers can extend. Attached to layer 52 is layer part 322, a layer of hook-and-loop material such as Velcro®, positioned to attach to layer part 324, shown in outline in FIG. 24.

Structure 320 also includes strap 330 and layer part 332, both of which are significantly different than components shown in FIGS. 1, 2, 22, and 23. The reverse side of strap 330 has hook-and-loop material such as Velcro® that adheres to layer part 332, which also has hook-and-loop material such as Velcro®. Therefore, rather than being positioned to pass through a loop and adhere to itself in a cinch-like arrangement similar to straps 60 in FIGS. 1, 2, 22, and 23, strap 330 is positioned at or near an end of structure 320, illustratively where layer 52 ends, and can adjustably extend over and adhere to layer part 332, which is in an appropriate counterpart position adjacent layer part 322 on layer 52. This positioning of strap 330 and layer part 332 avoids bunching and folding that can result from a cinch-like connection as shown, for example, in FIG. 1. As a result, structure 320 can be more comfortable to wear than structures with cinch-like connections.

Structures 300 and 320 and other similar structures described above could be fabricated in various other ways from various other materials. For example, a structure could be fabricated with techniques other than sewing, and could be fabricated in ways other than with layers of fabric or fabric-like material.

A product could include, in addition to release components and light components that are mountable on a handle structure as described above, one or more hand-engaging components. For example, the hand-engaging components could include a set of the wearable components described in relation to FIGS. 1, 2, and 22-24, a set of the grips described in relation to FIG. 21, and any other suitable hand-engaging components that have openings or spaces for the handle structure.

The implementations in FIGS. 1-24 illustrate examples of systems that include a release component, a light component, and a connecting component. The release component can hold and release a bowstring. The light component can emit light with a ray pattern sufficient to illuminate nearby objects. The connecting component can connect the release component and the light component.

In specific implementations, the light component includes a light source that emits light in response to electrical power, and the light source can emit light in a way that preserves night vision, such as by emitting predominantly blue, green, or red light. The light source can include a light emitting diode. The light component can also include an electrical circuit that provides electrical power to the light source, and it can include a switch mechanism such as a mechanism that is opened and closed by rotating the light component relative to a support structure. The support structure can include a chamber to hold a battery.

In further specific implementations, the connecting component can include a handle structure with opposite ends, with the release component mounted on one end and the light component mounted on the other. The handle structure can have an adjustable length between the two ends to fit different widths of hands; for example, the handle structure can have an outer part with an inner threaded surface and an inner part with an outer threaded surface, and the two parts can be rotated relative to each other to adjust the length of the handle structure by turning the inner and outer threaded surfaces against each other. The outer and inner parts can also be rotatable to disconnect from each other or, in a method of making, they can be rotated relative to each other to form a connection. In a method of use, both the light component and the release component can be operated, but not concurrently.

The implementations in FIGS. 1-24 also illustrate examples of apparatus to hold and release bowstrings. The apparatus includes a handle structure and a release component mounted on the handle structure. The release component includes a pivotable component that is mounted pivotably relative to the handle structure, allowing the pivotable component to pivot about an axis relative to the handle structure. The release component also includes a selecting component that can be operated to select a pivot mode, such as a mode in which the pivotable component can pivot about the axis through a range of positions relative to the handle structure or another mode in which the pivotable component is fixed in a position within the range. The release component also includes a trigger mechanism that can be actuated by a finger to cause bowstring release.

In specific implementations, the selecting component includes a pin about which the pivotable component pivots and a set screw in the pivotable component that can be turned to engage with or disengage from the pin. The handle structure can include an end with a groove defined in it, and the pivotable component can have a tongue portion that fits within the groove; the pin can extend through the end of the handle structure and the tongue portion. The handle structure can extend between a first end at which the release component is mounted and a second, opposite end, and the length between the two ends can be adjusted to fit different widths of hands. For example, the handle structure can have outer and inner parts with threaded surfaces that can turn against each other; by rotating the outer and inner parts relative to each other, one can adjust the length of the handle structure. The outer and inner parts can also be disconnected. The handle structure can also include a stopping component at its second end to hold a hand-engaging component in place on the handle structure.

In a specific method implementation, making the apparatus includes mounting the release component on the handle structure with the pivotable component mounted pivotably relative to the handle structure. In another specific method implementation, using the apparatus includes holding the handle structure in one's hand with the release component holding a bowstring and with the selecting component operated to select one of the modes; the trigger mechanism is actuated by a finger of one's hand to cause the release component to release the bowstring.

The implementations in FIGS. 1-24 also illustrate examples of an archery device that includes a wearable structure that can be worn on one's hand. When worn, the wearable structure has a finger opening defined therein through which one or more of one's fingers extend in a finger direction. Attached to the wearable structure adjacent the finger opening is a tube-like structure with an inner space extending approximately perpendicular to the finger direction between first and second openings. In use, a bowstring release extends through the inner space and out of both the first and second openings, so that one's fingers can extend through the finger opening and around the tube-like structure to hold the bowstring release within it.

In specific implementations, the wearable structure can also have a thumb opening positioned so that one's thumb can extend through it when one's fingers extend through the finger opening and positioned relative to the tube-like structure so that one's thumb can engage a thumb pin on the bowstring release. The inner space can be approximately cylindrical, and the first and second openings can be approximately equal in size.

In a specific method implementation, making the device includes attaching the tube-like structure to the wearable structure adjacent the finger opening with the inner space extending approximately perpendicularly to the finger direction between the first and second openings. In another specific method implementation, using the device includes inserting a bowstring release so that it extends through the inner space and out of both the first and second openings; the wearable structure is worn on one's hand with one or more fingers extending through the finger opening and around the tube-like structure, holding the bowstring release within it.

The implementations in FIGS. 1-24 also illustrate examples of products that include one or more hand-engaging components and a handle structure. Each of the hand-engaging components has a handle holding structure with an inner space extending between first and second openings. In use, the handle structure supports a release component that can hold and release bowstrings. The handle structure is insertable into the inner space of the handle holding structure of at least one of the hand-engaging components and has first and second ends that can extend out of the handle holding structure's first and second openings, respectively. The handle holding structure is positioned when one's hand is engaged with the hand-engaging component so that one's fingers can extend around the handle holding structure.

In specific implementations, at least one of the hand-engaging components can be a wearable component with a finger opening and a flexible tube-like structure as described above. The product can also include a release component mountable on the first end and including a thumb pin; the wearable component can have a thumb opening as described above so that one's thumb can extend through the thumb opening and contact the thumb pin. The thumb pin can be adjustable across a range of positions. At least one of the hand-engaging components can be a concho-type grip. The product can also include a light component mountable on the handle structure's second end, opposite the first end. The handle structure can include first and second parts that can be inserted into the first and second openings, respectively, and can be connected within the inner space. The second end of the handle structure can have a stopping component that, in use, contacts the handle holding structure around the second opening, holding it in place.

In a specific method implementation, a product can be used to hold and release bowstrings. The method can include inserting the handle structure into the inner space of the handle holding structure of one of the hand-engaging components with the first and second ends extending out of the first and second openings, respectively. With the handle structure supporting the release component, the hand-engaging component can be held to hold the release component. The act of inserting the handle structure can include inserting the first and second end parts into the first and second openings, and attaching the first and second end parts within the inner space. With inner and outer threaded surfaces, the first and second end parts can be attached by rotating them relative to each other, and this rotation can also adjust a length in which one's hand fits around them.

The implementations in FIGS. 1-24 also illustrate examples of apparatus that includes a hand-engaging component and a release component. The hand-engaging component includes a handle holding structure and the release component includes a handle structure with first and second opposite ends. The handle structure fits within an inner space of the handle holding structure with its first and second ends extending out of first and second openings, respectively. The handle structure has an adjustable length between the first and second ends to fit different widths of hands.

In specific implementations, the handle structure can have outer and inner parts as described above, and they are rotatable relative to each other to adjust the length. The handle structure can also include a stopping component, such as with a disk-like shape, at its second end to hold the handle holding structure in place. The hand-engaging component can be a wearable component or a concho-type grip.

In a specific method implementation, making the apparatus includes connecting the release component and the hand-engaging component, an act that includes inserting the handle structure into the inner space with the first and second ends extending out of the first and second openings, respectively. In another specific method implementation, using the apparatus includes adjusting the handle structure's length to fit a width of a hand and, with the hand, engaging the hand-engaging component and holding the handle structure in the handle holding structure.

The techniques described above in relation to FIGS. 1-24 make it possible to combine a bowstring release and a light into a single system, making it easy for an archer to enter or leave a hunting site in the dark. The use of a narrow frequency light preserves night vision. The selecting component makes it possible for the handle and the release assembly to pivot during use, so that the release can be allowed to float to the pressure direction exerted from the draw pull; alternatively, the release can be held in a fixed position by operating the selecting component. Similarly, the thumb pin can be adjusted, allowing the archer to more easily pull the draw weight during the bow draw cycle; in addition, the thumb pin can be positioned to fit an individual archer's hand. A similar adjustment can be made in the handle structure, so that it fits into various sizes of glove-like structures or concho grips for different widths of hands. Furthermore, the handle structure can be completely separated so that one type of glove-like structure or concho grip can be removed and another can be mounted. The archer therefore has a choice between different ways of holding the release.

The exemplary implementations described above are illustrated and have been successfully prototyped and tested with specific shapes, dimensions, materials and other characteristics, but the scope of the invention includes various other shapes, dimensions, materials and characteristics. For example, the particular shape of each of the parts could be different, and could be of appropriate sizes for any particular type of bowstring release. Furthermore, rather than being fabricated from separate parts or layers, including conventional machining techniques for smooth edges and so forth, the structures as described above could be manufactured in various other ways and could include various other materials. For example, some structures could be integrally formed, such as by molding a plastic material.

Similarly, the exemplary implementations described above include specific examples of release components, light components, connecting components, hand-engaging components, wearable components and structures, selecting components, pivotable components, stopping components, handle structures, support structures, fastening structures, glove-like structures, light structures, tube-like structures, handle holding structures, switch mechanisms, trigger mechanisms, and so forth, but any appropriate implementations of those components, structures, and mechanisms could be employed. Further, the above exemplary implementations employ specific ways of holding a release, but a wide-variety of other ways could be used within the scope of the invention, including any wrist-strap or handheld technique.

The exemplary implementations described above employ handle structures that include telescoping tubes, but various other techniques could be used to connect a release to a light or to position a release and a light relative to each other. Furthermore, the exemplary implementations employ a tube or tube-like structure to contain a handle, but differently shaped handles could be contained in differently shaped structures.

The exemplary implementations described above employ a light that can be turned on and off by rotating it relative to the handle structure, but any other type of switch could be used to activate the light, whether or not manually controlled. More generally, any appropriate type of light could be used, including types that are developed hereafter. Various other types of batteries besides those described above could be employed, and it may be possible to employ a power source other than a battery.

While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A system comprising:

a release component that can hold and release bowstrings;

a light component that can emit light with a ray pattern sufficient to illuminate nearby objects; and a connecting component that can connect the release component and the light component;

the system also including at least one of the following:

(1) a support structure; the light component being rotatable mounted on the support structure, the light component including:

a light source that emits light in response to electrical power;

an electrical circuit that provides the electrical power to the light source; the electrical circuit including a switch mechanism that opens and closes the electrical circuit in response to rotation of the light component relative to the support structure; and (2) a handle structure in the connecting component, the handle structure having:

first and second opposite ends; the release component being mounted on the handle structure's first end; the light component being mounted on the handle structure's second end;

an adjustable length between the first and second ends to fit different widths of hands; and an outer part with an inner threaded surface and an inner part with an outer threaded surface, the inner and outer threaded surfaces being capable of turning against each other; the outer and inner parts being rotatable relative to each other to adjust the length of the handle structure by turning the inner and outer threaded surfaces against each other.

2. The system of claim 1 in which the light source emits light in a way that preserves night vision.

3. The system of claim 2 in which the light source emits light that is predominantly blue, green, or red.

4. The system of claim 1 in which the light source includes a light emitting diode.

5. The system of claim 1 in which the support structure has a chamber to hold a battery; the electrical circuit connecting to a battery in the chamber.

6. The system of claim 1 in which the outer and inner parts of the handle structure are further rotatable to disconnect from each other.

7. A method of making the system of claim 1, comprising:

using the connecting component to connect the release component and the light component by rotating the outer part and the inner part of the connecting component relative to each other so that the inner threaded surface of the outer part and the outer threaded surface of the inner part turn against each other, forming a connection.

8. A method of using the system of claim 1, comprising:

operating the light component to illuminate at least one nearby object; and operating the release component to hold and release a bowstring;

the acts of operating the light component and operating the release component not being performed concurrently.

9. Apparatus to hold and release bowstrings, the apparatus comprising:

a handle structure that can be held by a hand;

a release component that can hold and release a bowstring; the release component being mounted on the handle structure; the release component including:

a pivotable component mounted pivotably relative to the handle structure so that the pivotable component can pivot about an axis relative to the handle structure;

a selecting component that can be operated to select one of a set of pivot modes, the set including a first mode in which the pivotable component can pivot about the axis through a range of positions relative to the handle structure and a second mode in which the pivotable component is fixed in a position within the range of positions relative to the handle structure, wherein the selecting component includes:

a pin about which the pivotable component pivots; and a set screw in the pivotable component that can be turned to engage with or disengage from the pin; and a trigger mechanism that can be actuated by a finger of a hand holding the handle structure to cause the release component to release a bowstring.

10. The apparatus of claim 9, in which the handle structure includes an end in which a groove is defined; the pivotable component having a tongue portion that fits within the groove; the pin extending through the end of the handle structure and the tongue portion.

11. The apparatus of claim 9 in which the handle structure extends between a first end at which the release component is mounted and a second end opposite the first end; the handle structure having an adjustable length between the first and second ends to fit different widths of hands.

12. The apparatus of claim 11 in which the handle structure has an outer part with an inner threaded surface and an inner part with an outer threaded surface, the inner and outer threaded surfaces being capable of turning against each other; the outer and inner parts being rotatable relative to each other to adjust the length of the handle structure by turning the inner and outer threaded surfaces against each other.

13. The apparatus of claim 12 in which the outer and inner parts are further rotatable to disconnect from each other.

14. The apparatus of claim 11 in which the handle structure further includes a stopping component at the second end to hold a hand-engaging component in place on the handle structure.

15. The apparatus of claim 9 in which the trigger mechanism is mounted on the pivotable component.

16. A method of making the apparatus of claim 9, comprising:

mounting the release component on the handle structure with the pivotable component mounted pivotably relative to the handle structure.

17. A method of using the apparatus of claim 9, comprising:

holding the handle structure in one's hand with the release component holding a bowstring and with the selecting component operated to select either the first mode or the second mode; and actuating the trigger mechanism by a finger of one's hand to cause the release component to release the bowstring.

18. An archery device comprising:

a wearable structure that can be worn on one's hand and that can be used with bowstring releases; when worn, the wearable structure having a finger opening defined therein through which one or more of one's fingers extend in a finger direction; and attached to the wearable structure adjacent the finger opening, a tube-like structure with an inner space extending approximately perpendicularly to the finger direction between first and second openings; in use, a bowstring release extending through the inner space and out of both the first and second openings so that one's fingers can extend through the finger opening and around the tube-like structure to hold the bowstring release within the tube-like structure.

19. The device of claim 18 in which the wearable structure further has a thumb opening defined therein, positioned relative to the finger opening so that one's thumb can extend through the thumb opening when one's fingers extend through the finger opening; the thumb opening further being positioned relative to the tube-like structure so that one's thumb can engage a thumb pin on the bowstring release.

20. The device of claim 18 in which the inner space of the tube-like structure is approximately cylindrical.

21. The device of claim 18 in which the first and second openings are approximately equal in size.

22. A method of making the device of claim 18, comprising:

attaching the tube-like structure to the wearable structure adjacent the finger opening with the inner space extending approximately perpendicularly to the finger direction between the first and second openings.

23. A method of using the device of claim 18 including:

inserting a bowstring release so that it extends through the inner space and out of both the first and second openings; and wearing the wearable structure on one's hand with one or more of one's fingers extending through the finger opening in the finger direction and around the tube-like structure, holding the bowstring release within the tube-like structure.

24. A product comprising:

one or more hand-engaging components, each of which has a handle holding structure with an inner space that extends between first and second openings; and a handle structure that, in use, supports a release component that can hold and release bowstrings; the handle structure being insertable into the inner space of the handle holding structure of at least one of the hand-engaging components and having first and second ends that, when the handle structure has been inserted into the inner space, extend out of the handle holding structure's first and second openings, respectively; the handle holding structure being positioned when one's hand is engaged with the hand-engaging component so that one's fingers can extend around the handle holding structure.

25. The product of claim 24 in which at least one of the hand-engaging components is a wearable component that can be worn on one's hand; when in use, the wearable component having a finger opening defined therein the handle holding structure being a flexible tube-like structure positioned relative to the finger opening so that one's fingers can extend through the finger opening and around the handle holding structure to hold the handle structure within the handle holding structure.

26. The product of claim 25, further comprising a release component that is mountable on the handle structure's first end; the release component including a thumb pin; the wearable component further having a thumb opening defined therein, positioned relative to the finger opening so that one's thumb can extend through the thumb opening and contact the thumb pin when one's fingers extend through the finger opening and around the handle holding structure.

27. The product of claim 26 in which the thumb pin is adjustable across a range of positions that includes at least one position in which one's thumb can exert pressure on the thumb pin while one's fingers extend through the finger opening and around the handle holding structure.

28. The product of claim 24 in which at least one of the hand-engaging components is a concho-type grip.

29. The product of claim 24 in which the apparatus further comprises:

a light component that can emit light with a ray pattern sufficient to illuminate nearby objects; the light component being mountable on the handle structure's second end.

30. The product of claim 24 in which the handle structure includes first and second parts that can be inserted into the first and second openings, respectively, of the handle holding structure of any of the hand-engaging components and can be connected within the inner space of the handle holding structure.

31. The product of claim 24 in which the second end of the handle structure has a stopping component that, in use, contacts the handle holding structure around the second opening, holding the handle holding structure in place on the handle structure.

32. The product of claim 24, further comprising a release component that is mountable on the handle structure's first end.

33. The product of claim 32 in which the release component includes a pivotable component that is pivotable relative to the handle structure when the release component is mounted on the handle structure's first end.

34. A method of using the product of claim 24 to hold and release bowstrings; the method comprising:

inserting the handle structure into the inner space of the handle holding structure of one of the hand-engaging components with the first and second ends of the handle structure extending out of the first and second openings, respectively; and with the handle structure supporting the release component, holding the hand-engaging component to hold the release component.

35. The method of claim 34 in which the handle structure includes first and second end parts that can be attached to and detached from each other; the act of inserting the handle structure comprising:

inserting the first and second end parts into the first and second openings, respectively; and attaching the first and second end parts within the inner space.

36. The method of claim 35 in which the first end part has an inner threaded surface and the second end part has an outer threaded surface, the inner and outer threaded surfaces being capable of turning against each other as the first and second end parts are rotated relative to each other; the act of attaching the first and second end parts including rotating the first and second end parts relative to each other.

37. The method of claim 36 in which the act of rotating the first and second end parts comprises adjusting a length in which one's hand fits around the first and second end parts.

38. Apparatus to hold and release bowstrings, the apparatus comprising:

a hand-engaging component that includes a handle holding structure with an inner space that extends between first and second openings; and a release component that can hold and release a bowstring; when in use, the release component being connected to the hand-engaging component; the release component including:

a handle structure with first and second opposite ends, the handle structure fitting within the inner space of the handle holding structure with the first and second ends extending out of the first and second openings, respectively; the handle structure having an adjustable length between the first and second ends to fit different widths of hands.

39. The apparatus of claim 38 in which the handle structure has an outer part with an inner threaded surface and an inner part with an outer threaded surface, the inner and outer threaded surfaces being capable of turning against each other; the outer and inner parts being rotatable relative to each other to adjust the length of the handle structure by turning the inner and outer threaded surfaces against each other.

40. The apparatus of claim 38 in which the handle structure further includes a stopping component at the second end to hold the handle holding structure in place on the handle structure.

41. The apparatus of claim 40 in which the stopping component has a disk-like shape.

42. The apparatus of claim 38 in which the hand-engaging component is one of a wearable component and a concho-type grip.

43. A method of making the apparatus of claim 38, comprising:

connecting the release component and the hand-engaging component; the act of connecting the release component and the hand-engaging component comprising:

inserting the handle structure into the inner space of the handle holding structure with the first and second ends extending out of the first and second openings, respectively.

44. A method of using the apparatus of claim 38, comprising:

adjusting the handle structure's length to fit a width of a hand; and with the hand, engaging the hand-engaging component and holding the handle structure in the handle holding structure.

45. An archery apparatus comprising:

a wearable structure that can be worn on one's hand; when worn, the wearable structure having a finger opening defined therein through which one or more of one's fingers extend in a finger direction;

attached to the wearable structure adjacent the finger opening, a tube-like structure with an inner space extending approximately perpendicularly to the finger direction between first and second openings;

a handle structure that can be held by a hand; the handle structure having first and second opposite ends and fitting within the inner space of the tube-like holding structure with the first and second ends extending out of the first and second openings, respectively, so that one's fingers can extend through the finger opening and around the tube-like structure to hold the bowstring release within the tube-like structure; the handle structure having an adjustable length between the first and second ends to fit different widths of hands;

a release component that can hold and release a bowstring; the release component being mounted on the handle structure's first end; the release component including:

a pivotable component mounted pivotably relative to the handle structure so that the pivotable component can pivot about an axis relative to the handle structure;

a selecting component that can be operated to select one of a set of pivot modes, the set including a first mode in which the pivotable component can pivot about the axis through a range of positions relative to the handle structure and a second mode in which the pivotable component is fixed in a position within the range of positions relative to the handle structure; and a trigger mechanism that can be actuated by a finger of a hand holding the handle structure to cause the release component to release a bowstring; and a light component that can emit light with a ray pattern sufficient to illuminate nearby objects; the light component being mounted on the handle structure's second end.

* * * * *

UNITED STATES PATENT AND TRADEMARK OFFICE

CERTIFICATE OF CORRECTION

PATENT NO. : 7,654,254 B1
APPLICATION NO. : 11/588908
DATED : February 2, 2010
INVENTOR(S) : Rentz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 480 days.

Signed and Sealed this

Twenty-third Day of November, 2010

David J. Kappos

David J. Kappos
*Director of the United States Patent and Trademark Office*